US011804675B2

(12) United States Patent
He et al.

(10) Patent No.: US 11,804,675 B2
(45) Date of Patent: Oct. 31, 2023

(54) PLUG CONNECTOR, RECEPTACLE CONNECTOR AND CONNECTOR ASSEMBLY

(71) Applicant: Tyco Electronics (Shanghai) Co. Ltd., Shanghai (CN)

(72) Inventors: Hua He, Shanghai (CN); Yong Wang, Shanghai (CN); Yingchun Wang, Shanghai (CN); Yong Yang, Shanghai (CN); Daokuan Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 93 days.

(21) Appl. No.: 17/201,363

(22) Filed: Mar. 15, 2021

(65) Prior Publication Data

US 2021/0296829 A1 Sep. 23, 2021

(30) Foreign Application Priority Data

Mar. 18, 2020 (CN) ..... 202020342968.3

(51) Int. Cl.

| | |
|---|---|
| ***H01R 13/6582*** | (2011.01) |
| ***H01R 13/502*** | (2006.01) |
| ***H01R 13/6597*** | (2011.01) |
| ***H01R 13/516*** | (2006.01) |
| ***H01R 13/40*** | (2006.01) |
| ***H01R 13/6591*** | (2011.01) |
| *H01R 13/622* | (2006.01) |
| *H01R 13/645* | (2006.01) |
| *H01R 13/6585* | (2011.01) |
| *H01R 13/6581* | (2011.01) |
| *H01R 13/658* | (2011.01) |
| *H01R 13/648* | (2006.01) |

(52) U.S. Cl.

CPC ..... *H01R 13/6582* (2013.01); *H01R 13/40* (2013.01); *H01R 13/502* (2013.01); *H01R 13/516* (2013.01); *H01R 13/6591* (2013.01); *H01R 13/6597* (2013.01); *H01R 13/622* (2013.01); *H01R 13/648* (2013.01); *H01R 13/6456* (2013.01); *H01R 13/658* (2013.01); *H01R 13/6581* (2013.01); *H01R 13/6585* (2013.01)

(58) Field of Classification Search

CPC .. H01R 13/6582; H01R 13/40; H01R 13/502; H01R 13/516; H01R 13/6591; H01R 13/6597; H01R 13/622; H01R 13/6456; H01R 13/648; H01R 13/658; H01R 13/6581; H01R 13/6585

See application file for complete search history.

(56) References Cited

U.S. PATENT DOCUMENTS

2017/0054258 A1* 2/2017 Little ..... H01R 13/6275
2019/0237912 A1* 8/2019 Little ..... H01R 43/24

FOREIGN PATENT DOCUMENTS

JP H10208814 A * 8/1998

* cited by examiner

*Primary Examiner* — Abdullah A Riyami
*Assistant Examiner* — Justin M Kratt
(74) *Attorney, Agent, or Firm* — Barley Snyder

(57) ABSTRACT

A plug connector includes a metal housing, an insulation body received in the metal housing, the insulation body having an insertion slot, a signal terminal disposed in the insulation body, a power terminal disposed in the insulation body, and a metal sheet. The metal sheet is disposed in the insertion slot. The signal terminal and the power terminal are separated from each other by the metal sheet.

22 Claims, 3 Drawing Sheets

PLUG CONNECTOR, RECEPTACLE CONNECTOR AND CONNECTOR ASSEMBLY

CROSS-REFERENCE TO RELATED APPLICATION

This application claims the benefit of the filing date under 35 U.S.C. § 119(a)-(d) of Chinese Patent Application No. 202020342968.3, filed on Mar. 18, 2020.

FIELD OF THE INVENTION

The present invention relates to a connector and, more particularly, to a connector protected from electromagnetic interference.

BACKGROUND

In order to improve an anti-electromagnetic interference capability of a connector, it is usually necessary to provide a metal shielding housing. The metal shielding housing is usually sleeved on an insulation body. Terminals of the connector are mounted in the insulation body and surrounded by the metal shielding housing. In this way, it is possible protect the signal terminals of the connector from an external electromagnetic interference. However, when the connector has both power terminals and signal terminals, the signal terminals still interfere with the power terminals, which reduces the signal transmission quality of the signal terminals.

SUMMARY

A plug connector includes a metal housing, an insulation body received in the metal housing, the insulation body having an insertion slot, a signal terminal disposed in the insulation body, a power terminal disposed in the insulation body, and a metal sheet. The metal sheet is disposed in the insertion slot. The signal terminal and the power terminal are separated from each other by the metal sheet.

BRIEF DESCRIPTION OF THE DRAWINGS

The invention will now be described by way of example with reference to the accompanying Figures, of which.

DETAILED DESCRIPTION OF THE EMBODIMENTS

Figure 1:
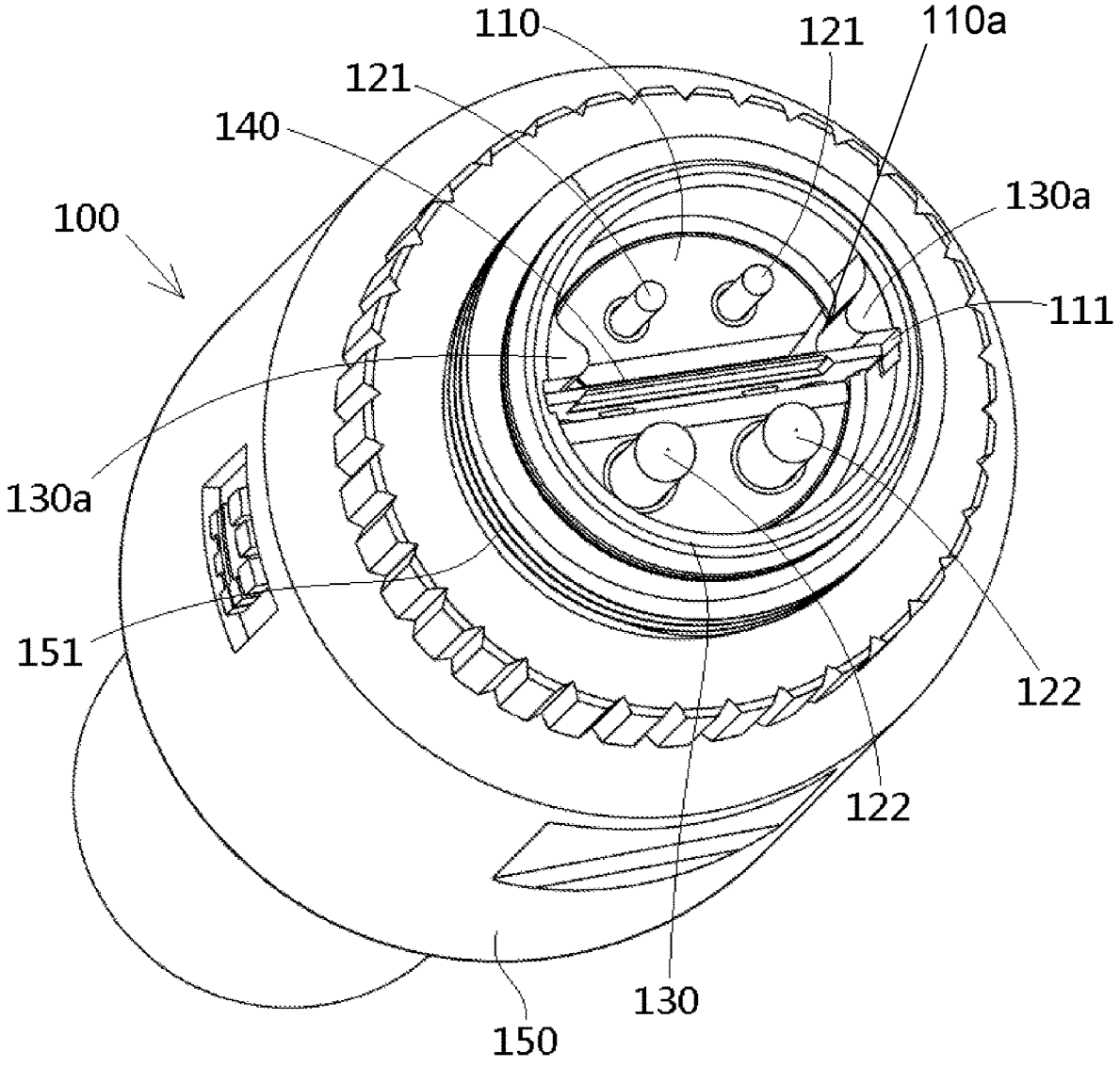
FIG. 1 is a perspective view of a plug connector according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

A plug connector 100 according to an embodiment is shown in FIG. 1. The plug connector 100 includes a metal housing 130, an insulation body 110, a signal terminal 121, and a power terminal 122. The insulation body 110 is received in the metal housing 130. The signal terminal 121 is provided in the insulation body 110. The power terminal 122 is provided in the insulation body 110.

As shown in FIG. 1, in the illustrated embodiment, an insertion slot 111 is formed in the insulation body 110. The plug connector 100 has a metal sheet 140. The metal sheet 140 is inserted into the insertion slot 111. The signal terminal 121 and the power terminal 122 are separated from each other by the metal sheet 140 to prevent the signal terminal 121 from being affected by electromagnetic interference with the power terminal 122.

As shown in FIG. 1, in the illustrated embodiment, the metal sheet 140 is in electrical contact with an inner wall of the metal housing 130 at both sides thereof so as to divide an inner space of the metal housing 130 into two electromagnetic shielding spaces closed in a circumferential direction, respectively. The signal terminal 121 is located in one of the two electromagnetic shielding spaces, and the power terminal 122 is located in the other of the two electromagnetic shielding spaces.

As shown in FIG. 1, in the illustrated embodiment, the insertion slot 111 is located in a plane passing through a central axis of the insulation body 110.

As shown in FIG. 1, in the illustrated embodiment, at least one rib-shaped protrusion 130*a* is formed on the inner wall of the metal housing 130. The at least one rib-shaped protrusion 130*a* extends in a direction parallel to an axis of the metal housing 130. At least one positioning groove 110*a* respectively corresponding to the at least one rib-shaped protrusion 130*a* is formed on an outer wall of the insulation body 110, and the at least one rib-shaped protrusion 130*a* is positioned in the at least one positioning groove 110*a*, respectively. In the embodiment shown in FIG. 1, a plurality of rib-shaped protrusions 130*a* are formed on the inner wall of the metal housing 130, the plurality of rib-shaped protrusions 130*a* are distributed along a circumferential direction of the metal housing 130 at a predetermined interval. That is, the plurality of rib-shaped protrusions 130*a* are evenly distributed around the central axis of the metal housing 130.

In the embodiment shown in FIG. 1, the plug connector 100 includes a metal sleeve 150. The metal sleeve 150 is sleeved on the metal housing 130. An external thread adapted to be threadedly connected with a metal housing 230 of a receptacle connector 200 is formed on an outer wall of an end portion 151 of the metal sleeve 150.

Figure 2:
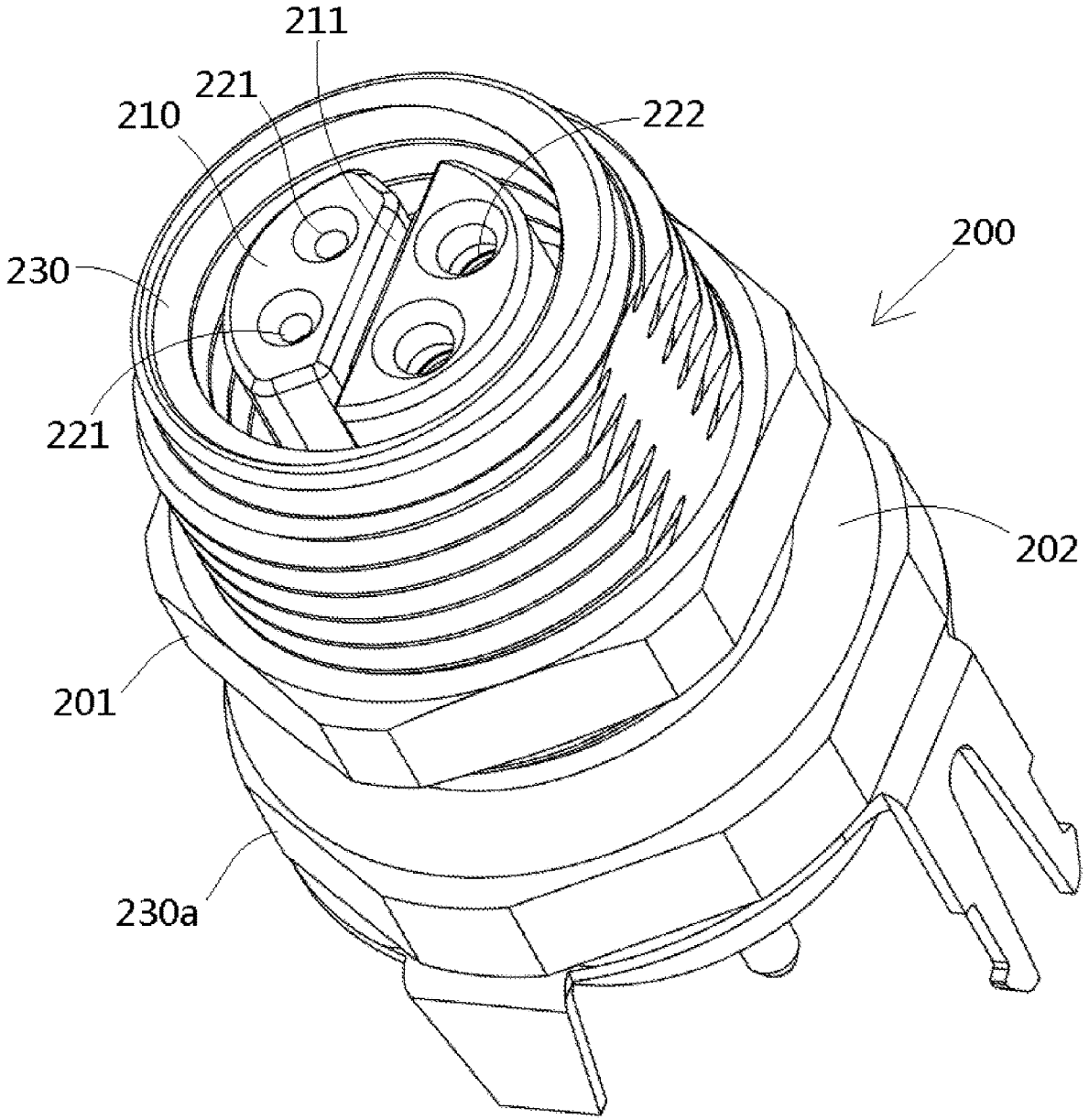
FIG. 2 is a perspective view of a receptacle connector according to an embodiment.

A receptacle connector 200 according to an embodiment is shown in FIG. 2. The receptacle connector 200 includes a metal housing 230, an insulation body 210, a signal terminal 221, and a power terminal 222. The insulation body 210 is received in the metal housing 230. The signal terminal 221 is provided in the insulation body 210. The power terminal 222 is provided in the insulation body 210.

As shown in FIG. 2, in the illustrated embodiment, an insertion slot 211 is formed in the insulation body 210. The receptacle connector 200 has a metal sheet 240. The metal sheet 240 is inserted into the insertion slot 211. The signal terminal 221 and the power terminal 222 are separated from each other by the metal sheet 240 to prevent the signal terminal 221 from electromagnetic interference with the power terminal 222. As shown in the embodiments of FIGS. 2 and 3, the insertion slot 211 is located in a plane passing through a central axis of the insulation body 210.

Figure 3:
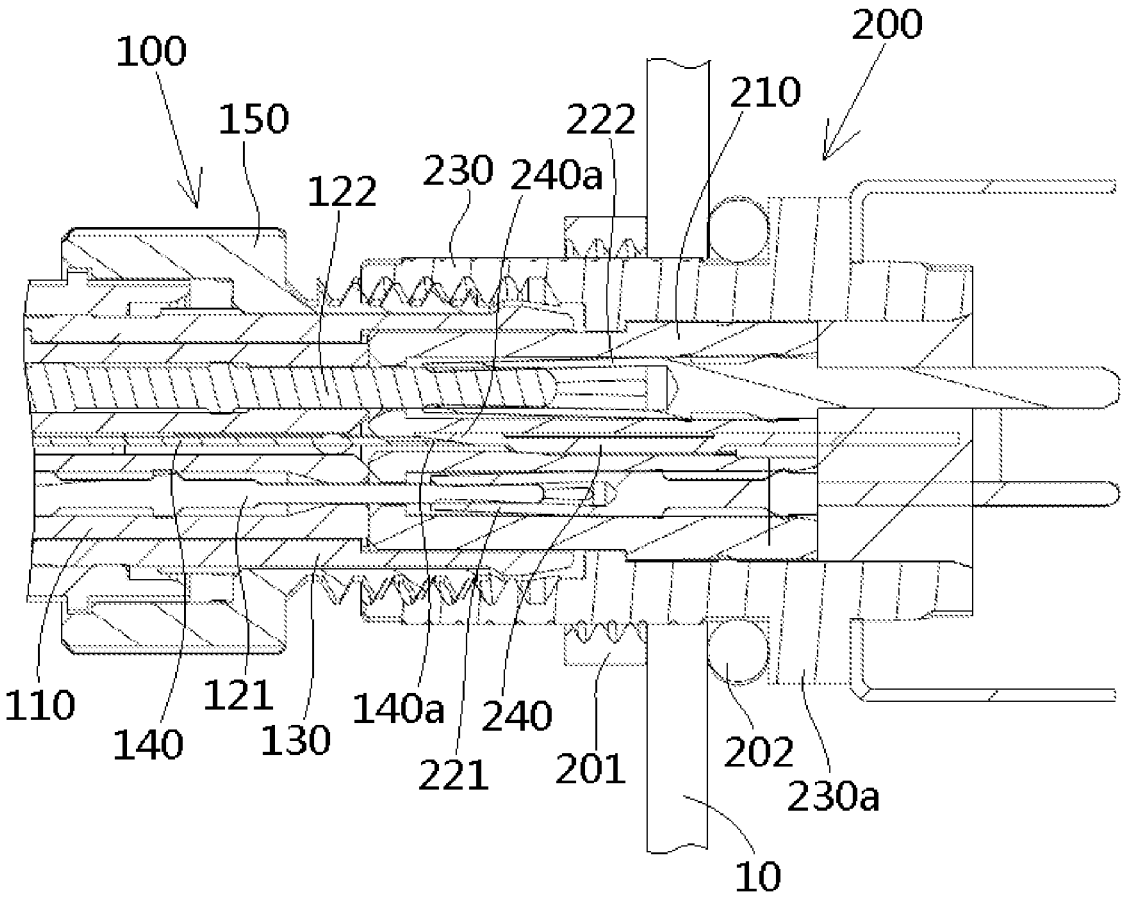
FIG. 3 is a sectional side view of the plug connector of FIG. 1 mated with the receptacle connector of FIG. 2.

As shown in FIGS. 2 and 3, in the illustrated embodiment, the metal sheet 240 is in electrical contact with an inner wall of the metal housing 230 at both sides thereof to divide an inner space of the metal housing 230 into two electromagnetic shielding spaces closed in a circumferential direction, respectively. The signal terminal 221 is located in one of the two electromagnetic shielding spaces, and the power terminal 222 is located in the other of the two electromagnetic shielding spaces.

As shown in FIGS. 2 and 3, in the illustrated embodiment, an internal thread adapted to be threadedly connected with a metal sleeve 150 of a plug connector 100 is formed on an inner wall of an end portion of the metal housing 230.

As shown in FIGS. 2 and 3, in the illustrated embodiment, the metal housing 230 has a flange-shaped base portion 230*a*. The receptacle connector 200 has a nut 201 adapted to be threadedly connected on a main body portion of the metal housing 230. The main body portion of the metal housing 230 is adapted to pass through a through hole formed in a mounting panel 10, shown in FIG. 3. The nut 201 and the base portion 230*a* are adapted to be positioned on both sides of the mounting panel 10, respectively, so that the receptacle connector 200 may be fixed to the mounting panel 10 by screwing the nut 201.

As shown in FIGS. 2 and 3, in the illustrated embodiment, the receptacle connector 200 further comprises an elastic sealing ring 202. The elastic sealing ring 202 is sleeved on the main body portion of the metal housing 230 and adapted to be compressed between the mounting panel 10 and the base portion 230*a* of the metal housing 230 to realize a seal between the receptacle connector 200 and the mounting panel 10.

As shown in FIGS. 1 to 3, in the illustrated embodiment, a connector assembly includes the plug connector 100 shown in FIG. 1 and the receptacle connector 200 shown in FIG. 2. The receptacle connector 200 is adapted to mate with the plug connector 100, as shown in FIG. 3.

As shown in FIGS. 1 to 3, in the illustrated embodiment, when the plug connector 100 and the receptacle connector 200 are mated together, an end portion 140*a* of the metal sheet 140 of the plug connector 100 is at least partially overlapped with an end portion 240*a* of the metal sheet 240 of the receptacle connector 200. When the plug connector 100 and the receptacle connector 200 are mated together, the end portion 140*a* of the metal sheet 140 of the plug connector 100 is brought in electrical contact with the end portion 240*a* of the receptacle connector 200.

As shown in FIGS. 1 to 3, in the illustrated embodiment, an end portion 151 of the metal sleeve 150 of the plug connector 100 is threadedly connected with the end portion of the metal housing 230 of the receptacle connector 200 when the plug connector 100 and the receptacle connector 200 are mated together.

As shown in FIGS. 1 to 3, in the illustrated embodiment, ends portions of the signal terminal 121 and the power terminal 122 of the plug connector 100 are in the shape of solid rod, and end portions of the signal terminal 221 and the power terminal 222 of the receptacle connector 200 are in the shape of hollow cylinder. When the plug connector 100 and the receptacle connector 200 are mated together, the end portions of the signal terminal 121 and the power terminal 122 of the plug connector 100 are inserted into the end portions of the signal terminal 221 and the power terminal 222 of the receptacle connector 200, respectively.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle. Although the disclosure have been described hereinbefore in detail with reference to the attached drawings, it should be appreciated that the disclosed embodiments in the attached drawings are intended to illustrate embodiments of the disclosure by way of example, and should not be construed as limitation to the disclosure. Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

What is claimed is:

1. A plug connector, comprising:

a metal housing;

an insulation body received in the metal housing, the insulation body having an insertion slot;

a signal terminal disposed in the insulation body;

a power terminal disposed in the insulation body; and a metal sheet disposed in the insertion slot and electrically contacting an inner wall of the metal housing at a pair of opposite sides to divide an inner space of the metal housing into a pair of electromagnetic shielding spaces closed in a circumferential direction, the signal terminal and the power terminal are separated from each other by the metal sheet.

2. The plug connector of claim 1, wherein the signal terminal is in one of the electromagnetic shielding spaces and the power terminal is in the other of the electromagnetic shielding spaces.

3. The plug connector of claim 1, wherein the insertion slot is disposed in a plane passing through a central axis of the insulation body.

4. The plug connector of claim 1, wherein the metal housing has a rib-shaped protrusion on an inner wall, the rib-shaped protrusion extending in a direction parallel to an axis of the metal housing.

5. The plug connector of claim 4, wherein the insulation body has a positioning groove on an outer wall of the insulation body, the positioning groove corresponds to the rib-shaped protrusion and the rib-shaped protrusion is positioned in the positioning groove.

6. The plug connector of claim 5, wherein the inner wall of the metal housing has a plurality of rib-shaped protrusions distributed along a circumferential direction of the metal housing at a predetermined interval.

7. The plug connector of claim 1, further comprising a metal sleeve that is sleeved on the metal housing, an external thread adapted to be threadedly connected with a metal housing of a receptacle connector is formed on an outer wall of an end portion of the metal sleeve.

8. The connector assembly of claim 1, wherein the insertion slot is open when the metal sheet is disposed within the insertion slot.

9. A receptacle connector, comprising:

a metal housing including a threaded end portion adapted to be threadedly connected with a metal sleeve of a plug connector;

an insulation body received in the metal housing, the insulation body having an insertion slot;

a signal terminal disposed in the insulation body;

a power terminal disposed in the insulation body; and a metal sheet disposed in the insertion slot, the signal terminal and the power terminal are separated from each other by the metal sheet.

10. The receptacle connector of claim 9, wherein the metal sheet electrically contacts an inner wall of the metal housing at a pair of opposite sides to divide an inner space of the metal housing into a pair of electromagnetic shielding spaces closed in a circumferential direction, the signal terminal is in one of the electromagnetic shielding spaces and the power terminal is in the other of the electromagnetic shielding spaces.

11. The receptacle connector of claim 9, wherein the insertion slot is disposed in a plane passing through a central axis of the insulation body.

12. The receptacle connector of claim 9, wherein the threaded end portion includes an internal thread formed on an inner wall of the metal housing.

13. The receptacle connector of claim 9, further comprising a nut adapted to be threadedly connected on a main body portion of the metal housing, the main body portion extends through a through hole formed in a mounting panel, the nut and a flange-shaped base portion of the metal housing are positioned on opposite sides of the mounting panel and the receptacle connector is fixed to the mounting panel by screwing the nut.

14. The receptacle connector of claim 13, further comprising an elastic sealing ring sleeved on the main body portion and compressed between the mounting panel and the flange-shaped base portion to seal between the receptacle connector and the mounting panel.

15. A connector assembly, comprising:

a plug connector including a first metal housing, a first insulation body received in the first metal housing, the first insulation body having a first insertion slot, a first signal terminal disposed in the first insulation body, a first power terminal disposed in the first insulation body, and a first metal sheet disposed in the first insertion slot, the first signal terminal and the first power terminal are separated from each other by the first metal sheet; and a receptacle connector adapted to mate with the plug connector, the receptacle connector including a second metal housing, a second insulation body received in the second metal housing, the second insulation body having a second insertion slot, a second signal terminal disposed in the second insulation body, a second power terminal disposed in the second insulation body, and a second metal sheet disposed in the second insertion slot, the second signal terminal and the second power terminal are separated from each other by the second metal sheet.

16. The connector assembly of claim 15, wherein, when the plug connector and the receptacle connector are mated, an end portion of the first metal sheet is at least partially overlapped with an end portion of the second metal sheet.

17. The connector assembly of claim 15, wherein, when the plug connector and the receptacle connector are mated, an end portion of the first metal sheet is electrically connected with an end portion of the second metal sheet.

18. The connector assembly of claim 15, wherein the plug connector has a metal sleeve that is sleeved on the first metal housing, and when the plug connector and the receptacle connector are mated, an end portion of the metal sleeve is threadedly connected with an end portion of the second metal housing.

19. The connector assembly of claim 15, wherein an end portion of each of the first signal terminal and the first power terminal have a shape of a solid rod, and an end portion of each of the second signal terminal and the second power terminal have a shape of a hollow cylinder.

20. The connector assembly of claim 19, wherein, when the plug connector and the receptacle connector are mated, the end portions of the first signal terminal and the first power terminal are inserted into the end portions of the second signal terminal and the second power terminal.

21. The connector assembly of claim 15, wherein the first insertion slot has a slot opening, and the first metal sheet extends beyond this slot opening.

22. The connector assembly of claim 15, wherein the second insertion slot has a slot opening, and the second metal sheet is recessed from the slot opening.

* * * * *